United States Patent [19]

Fort

[11] Patent Number: 4,697,837

[45] Date of Patent: Oct. 6, 1987

[54] GRIPPER FOR TEXTILE LAYER OR THE LIKE

[75] Inventor: Jacques Fort, Darnieulles, France

[73] Assignee: Les Applications Industrielles Vosiennes ("S.A.P.I.V.O.G"), Darnieulles, France

[21] Appl. No.: 820,085

[22] Filed: Jan. 21, 1986

[30] Foreign Application Priority Data

Jan. 22, 1985 [FR] France ..... 85 00825

[51] Int. Cl.[4] ..... B25J 15/08; B65H 3/00

[52] U.S. Cl. ..... 294/88; 271/268; 294/115; 294/118

[58] Field of Search ..... 294/61, 88, 106, 115, 294/116, 118, 119; 271/18.3, 268

[56] References Cited

U.S. PATENT DOCUMENTS

| | | | |
|---|---|---|---|
| 902,344 | 10/1908 | Teare | 294/119 X |
| 1,575,185 | 3/1926 | Stenhouse | 284/88 X |
| 1,717,194 | 6/1929 | Daoust | 294/106 |
| 2,215,844 | 9/1940 | Van Syckle | 294/116 X |
| 2,676,837 | 4/1954 | Wagner et al. | 294/88 |
| 3,701,328 | 10/1972 | Frost | 112/121.19 |

FOREIGN PATENT DOCUMENTS

| | | | |
|---|---|---|---|
| 13405 | 4/1956 | Fed. Rep. of Germany | 294/115 |
| 2523560 | 9/1983 | France . | |
| 408960 | 6/1945 | Italy | 294/115 |

*Primary Examiner*—Johnny D. Cherry

*Attorney, Agent, or Firm*—Fisher, Christen & Sabol

[57] ABSTRACT

Gripper, whose tongs are formed by two oscillating jaws, is distinguished by the fact that, on the one hand, these jaws are solid in rotation with two shafts rotating in bearings carried by a frame solid with the rod of a jack and, on the other hand, the rotation of this shaft is caused by the angular movement of a maneuvering part connecting each shaft to a stationary part.

2 Claims, 2 Drawing Figures

GRIPPER FOR TEXTILE LAYER OR THE LIKE

BACKGROUND OF THE INVENTION

1. Field of the Invention

The invention relates to a gripper particularly applicable to an unstacking device able to remove layer after layer from a textile mat or similar stacking.

2. Prior Art

Grippers applicable to unstacking devices able to remove layer after layer from a textile mat or similar stacking, like that described in French Published Patent Document No. A-2,523,560, are comprised of tongs and means to open and close these tongs. The tongs claimed in the French patent comprise: a stationary central part provided laterally and on each side with an elastic part; two crossing branches to constitute the gripper nose; each of the branches, preferably in the extension of the elastic part, being provided with a key. The opening and closing means of such tongs consist of two vertically mobile pins (one per branch) that, in their low position, can periodically come to apply on such keys to deform the elastic parts and to modify the crossing of the constitutive parts of the nose.

BROAD DESCRIPTION OF THE INVENTION

The invention provides another type of tongs and other means controlling their opening and closing. In the invention device, the tongs consist of a frame, which is mobile in height and solid with the rod of a jack, two shafts rotating in bearings fastened to this frame, and two jaws having angular movements controlled by these shafts. The maneuvering means are two sets of crossed rods whose lower ends are each fastened to one of such shafts and whose upper ends are hinged on stationary points of the gripper, preferably, a plate. By separating the mobile frame from this plate or bringing it closer to the plate, the maneuvering jack modifies the crossing of the rods which makes the shafts rotate and consequently causes the jaws to open or close.

BRIEF DESCRIPTION OF THE DRAWING

Other features and advantages of the invention are apparent from the following description and claims, with reference to the drawing. In the drawing:

DETAILED DESCRIPTION OF THE INVENTION

Figure 1:
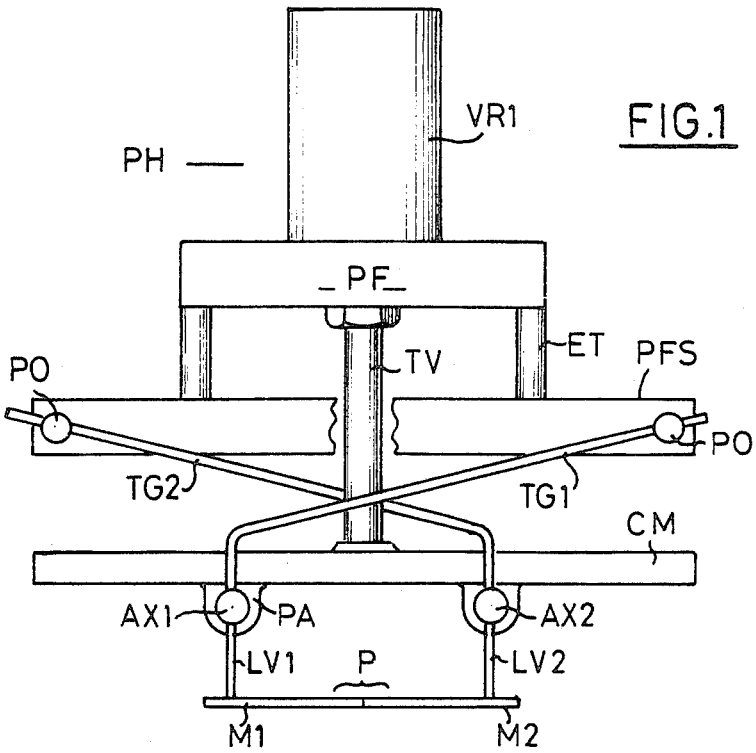
FIG. 1 is a front elevational view of the gripper, the object of the invention, in closed position.
Figure 2:
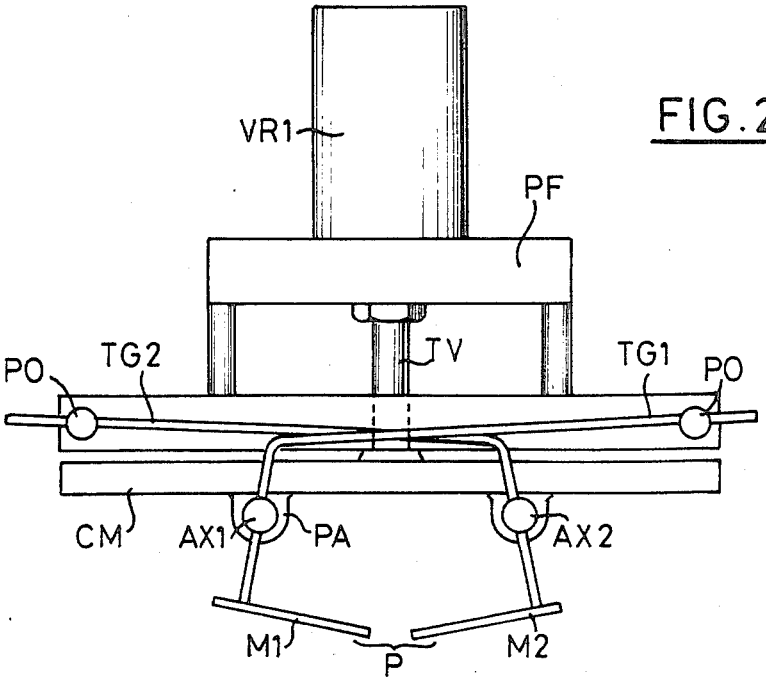
FIG. 2 is an identical front elevational view of the invention gripper but in open position.

The preferred embodiment of the invention is shown in FIGS. 1 and 2.

As seen in FIGS. 1 and 2, gripper PH comprises a vertically stationary part consisting of stationary plate PF with which, on the one hand, a jack VR1 is solid (fixed) and, on the other hand, a second stationary plate PFS is solid (fixed) by braces such as ET. A mobile frame CM, carrying two shafts AX1, AX2 rotating in bearings PA fastened to frame CM, is solid (fixed) with the end of rod TV of piston VR1. A lever LV1 (or LV2), fastened perpendicularly to a jaw M1 (or M2), is solid (fixed) with each shaft (AX1 or AX2). A rod TG1 (or TG2), whose other end is hinged on stationary plate PFS, is also angularly solid with each shaft AX1 (or AX2). Rods TG1 and TG2 cross, the angle of their virtual pivoting point being able to vary according to the distance of frame CM from plate PFS. The hinging of each rod on the plate is formed by pin PO rotating in relation to the stationary part as a function of the variation of the angle formed by the rod with the plate. Advantageously, the jaws (M1 and M2) are made of parts whose profiles are toothed in relation to one another.

To go from the open position (FIG. 2) to the closed position, therefore gripping position, (FIG. 1), rod TV comes out of jack VR1, a movement that moves frame CM away from stationary plate PFS and, therefore, modifies the virtual pivoting angle of rods TG1-TG2. Modification of this angle is possible only because the ends of these rods are hinged, on the one hand, on stationary plate PFS and, on the other hand, on frame CM, the angular modification of each rod being produced by a rotation of pins PO and of shafts AX1 (AX2). This rotation produces the angular movement of the jaws, rods TG1-TG2 sliding in pins PO.

The new invention gripper can be incorporated in an unstacking device like that described in French Pat. No. A-2,253,560. The new invention gripper offers advantages over known grippers and particularly over the elastic tong gripper. This is the object of the patent, particularly since it practically no longer ruffles the layer at the moment of gripping, and thus avoids an unwanted movement of the next layer.

What is claimed is:

1. Gripper useful for a textile machine unstacking device able to remove layer after layer from a textile mat stacking comprising tongs formed by two mobile jaws movable in angular movements, said jaws being fixed as to rotation with two shafts, said two shafts rotatable in bearings carried by a movable frame and said movable frame connected with a vertically extensible rod of a jack, whereby rotation of said two shafts can be caused by angular movement of a maneuvering part connecting each of said two shafts to a stationary plate fixed to said jack, wherein said maneuvering part is two crossing rods having each lower end thereof correspondingly fastened to one of said two shafts and each upper end thereof correspondingly slidably engaged with one of two rotating pins carried by said stationary plate.

2. A method for removing layer after layer from a textile mat stacking with a textile unstacking device having incorporated therein a gripper, said gripper having tongs formed by two mobile jaws movable in angular movements, said jaws being fixed as to rotation with two shafts, said two shafts rotatable in bearings carried by a movable frame and said movable frame connected with a vertically extensible rod of a jack, whereby rotation of said two shafts can be caused by angular movement of a maneuvering part connecting each of said two shafts to a stationary plate fixed to said jack, wherein said maneuvering part is two crossing rods having each lower end thereof correspondingly fastened to one of said two shafts and each upper end thereof correspondingly slidably engaged with one of two rotating pins carried by said stationary plate, comprising steps of vertically extending and next retracting said vertically extensible rod of said jack, thus, correspondingly, moving said movable frame away from and next toward said stationary plate fixed to said jack, moving said maneuvering part angularly, rotating said two shafts and said two pins and sliding said each upper end of said two crossing rods in and next out of each of said two pins, closing and next opening said jaws by angular movement into and next out of their textile mat stacking layer gripping position, and further repeating same steps, whereby layer after layer is removed from said textile mat stacking with practically no ruffling of each layer by the movement of gripping and avoiding an unwanted movement of the next layer.

* * * * *